US007993759B2

(12) United States Patent
Nagaraj et al.

(10) Patent No.: US 7,993,759 B2
(45) **Date of Patent: *Aug. 9, 2011**

(54) CORROSION COATING FOR TURBINE BLADE ENVIRONMENTAL PROTECTION

(75) Inventors: Bangalore A. Nagaraj, West Chester, OH (US); Mark D. Gorman, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 737 days.

This patent is subject to a terminal disclaimer.

(21) Appl. No.: 11/968,368

(22) Filed: Jan. 2, 2008

(65) Prior Publication Data

US 2010/0040476 A1 Feb. 18, 2010

Related U.S. Application Data

(62) Division of application No. 11/358,339, filed on Feb. 21, 2006, now Pat. No. 7,597,934.

(51) Int. Cl.

| | |
|---|---|
| ***B32B 15/00*** | (2006.01) |
| ***F03B 3/12*** | (2006.01) |
| ***B63H 7/00*** | (2006.01) |
| ***F03B 1/02*** | (2006.01) |

(52) U.S. Cl. ..... 428/678; 416/241 R; 416/248; 416/244 R

(58) Field of Classification Search ..... None
See application file for complete search history.

(56) References Cited

U.S. PATENT DOCUMENTS

| | | | |
|---|---|---|---|
| RE26,001 | E | 4/1966 | Wachtell et al. |
| 3,656,919 | A | 4/1972 | Lucas et al. |
| 4,310,574 | A | 1/1982 | Deadmore et al. |
| 4,500,364 | A | 2/1985 | Krutenat |
| 4,687,684 | A | 8/1987 | Restall et al. |
| 5,547,770 | A | 8/1996 | Meelu et al. |
| 5,650,235 | A | 7/1997 | McMordie et al. |

(Continued)

FOREIGN PATENT DOCUMENTS

| | | |
|---|---|---|
| CN | 1422974 | 6/2003 |

(Continued)

OTHER PUBLICATIONS

Neff, Robert A., Katz, Gerald B., Nagaraj, B., and Tarvin, Rachel; Metallurgical Analysis of Rainbow Rotor Coatings: Analysis of Fleet Blades; American Society of Mechanical Engineers; Jun. 2004; pp. 1-11; International Gas Turbine Institute.

*Primary Examiner* — Gordon R Baldwain

(74) *Attorney, Agent, or Firm* — McNees Wallace & Nurick LLC

(57) ABSTRACT

A gas turbine engine turbine blade comprising an airfoil section, a platform section, an under platform section, and a dovetail section, an exterior surface of the dovetail section comprising a shank exterior surface and a serrated exterior surface. The blade further comprises a silicon-modified diffusion aluminide layer a surface of a turbine blade section selected from the group consisting of an exterior surface of the under platform section, the exterior surface of the dovetail section, and combinations thereof, the silicon modified diffusion aluminide layer having a concentration of silicon at a surface of the silicon-modified diffusion aluminide layer in the range of about 1 weight percent to about 10 weight percent and a concentration of aluminum at the surface of the silicon modified diffusion aluminide layer in the range of about 5 weight percent to about 25 weight percent.

20 Claims, 3 Drawing Sheets

U.S. PATENT DOCUMENTS

| | | | |
|---|---|---|---|
| 5,795,659 | A | 8/1998 | Meelu et al. |
| 5,843,585 | A | 12/1998 | Alperine et al. |
| 6,010,746 | A | 1/2000 | Descoteaux et al. |
| 6,126,758 | A | 10/2000 | Meelu et al. |
| 6,435,826 | B1 | 8/2002 | Allen et al. |
| 6,458,473 | B1 | 10/2002 | Conner et al. |
| 6,497,920 | B1 | 12/2002 | Pfaendtner et al. |
| 6,520,401 | B1 | 2/2003 | Miglietti |
| 6,635,362 | B2 | 10/2003 | Zheng |
| 6,676,992 | B2 | 1/2004 | Pfaendtner et al. |
| 6,805,906 | B2 | 10/2004 | Moravek et al. |
| 6,881,439 | B2 | 4/2005 | Graham et al. |
| 2002/0127112 | A1 | 9/2002 | Stowell et al. |
| 2003/0221315 | A1 | 12/2003 | Baumann et al. |
| 2004/0261914 | A1 | 12/2004 | Boucard et al. |

FOREIGN PATENT DOCUMENTS

| | | |
|---|---|---|
| EP | 1111192 | 6/2001 |

CORROSION COATING FOR TURBINE BLADE ENVIRONMENTAL PROTECTION

CROSS-REFERENCE TO RELATED APPLICATIONS

This application is a divisional of U.S. Utility application Ser. No. 11/358,339, filed on Feb. 21, 2006, entitled "CORROSION COATING FOR TURBINE BLADE ENVIRONMENTAL PROTECTION", which is incorporated herein by reference in its entirety.

STATEMENT REGARDING FEDERALLY SPONSORED RESEARCH OR DEVELOPMENT

The United States Government retains license rights in this invention and the right in limited circumstances to require the patent owner to license others on reasonable terms by the terms of Government Contract No. S8A awarded by the Department of the Air Force.

FIELD OF THE INVENTION

The present invention relates generally to a corrosion resistant coating and more particularly to a method of applying a corrosion resistant coating to an under platform surface of a gas turbine engine turbine blade.

BACKGROUND OF THE INVENTION

In an aircraft gas turbine engine, air is drawn into the front of the engine, compressed by a shaft-mounted compressor, and mixed with fuel. The mixture is burned, and the hot exhaust gases are passed through a turbine mounted on the same shaft. The flow of combustion gas turns the turbine by impingement against the airfoil section of the turbine blades, which turns the shaft and provides power to the compressor. The hot exhaust gases flow from the back of the engine, driving it and the aircraft forward. The hotter the combustion and exhaust gases, the more efficient is the operation of the jet engine. Thus, there is incentive to raise the combustion gas temperature.

The compressors and turbine of the turbine engine can comprise turbine disks (sometimes termed "turbine rotors") or turbine shafts, as well as a number of blades mounted to the turbine disks/shafts and extending radially outwardly therefrom into the gas flow path, and rotating. Also included in the turbine engine are rotating, as well as static, seal elements that channel the airflow used for cooling certain components such as turbine blades and vanes. The airflow channeled by these rotating, as well as static, seal elements carry corrodant deposits to the non-gas path sides of turbine blades. As the maximum operating temperature of the turbine engine increases, the turbine blades are subjected to higher temperatures. As a result, oxidation and corrosion of the turbine blades have become of greater concern.

Metal salts such as alkaline sulfate, sulfites, chlorides, carbonates, oxides, and other corrodant salt deposits resulting from ingested dirt, fly ash, volcanic ash, concrete dust, sand, sea salt, etc. are a major source of the corrosion, but other elements in the bleed gas environment can also accelerate the corrosion. Alkaline sulfate corrosion in the temperature range and atmospheric region of interest results in pitting of the turbine blade substrate at temperatures typically starting around 1200° F. (649° C.). This pitting corrosion has been shown to occur on turbine blades, primarily the region beneath platforms of turbine blades. The oxidation and corrosion damage can lead to failure or premature removal and replacement of the turbine blades unless the damage is reduced or repaired.

Turbine blades for use at the highest operating temperatures are typically made of nickel-base superalloys selected for good elevated temperature strength and fatigue resistance. In addition, the turbine blade alloys are coated with environmental coatings to primarily protect the turbine airfoil and platform structures for oxidation and corrosion. These coatings may additionally be deposited on the under platform region of the turbine blade. Typical environmental coatings in wide use include MCrAlX overlay coatings (where M is iron, cobalt and/or nickel, and X is yttrium or another rare earth element), and diffusion coatings that contain aluminum intermetallics, predominantly beta-phase nickel aluminide (βNiAl) and platinum aluminides (PtAl). These superalloys and the existing environmental coatings used have resistance to oxidation and corrosion damage, but that resistance is not sufficient to protect them at sustained operating conditions now common in gas turbine engines. Newer superalloys have lower chromium content and are more susceptible to hot corrosion at such operating conditions.

Cooler areas on turbine blades are susceptible to hot corrosion attach. This hot corrosion attack is often particularly severe in the under platform areas where contaminants accumulate and service temperature is in the range of fastest attack. Coatings are often used to provide protection. However, these coatings can result in significant production difficulties. The most common coating for the under platform area and/or shank portion of the dovetail section is platinum aluminide. Platinum plating control in the complex geometry of the under platform area and the shank portion of the dovetail is very difficult. And PtAl coating is considered expensive. Parts with complex coating requirements require difficult masking and in-process strip cycles in order to obtain the proper coating in certain areas and avoidance in other areas. In severe applications it is observed that the PtAl has corrosion resistance that is insufficient for desired part life.

What is needed are methods of coating and coating compositions for turbine blades that: (1) provide corrosion resistance, especially at elevated temperatures where corrosion damage is more severe; (2) can be applied at a relatively low temperature with no need for in-process stripping of preselected areas; (3) can be formed by relatively uncomplicated and inexpensive methods; (4) are compatible with other part coating(s); and (5) can be used to refurbished exiting parts for continued engine operation. The present invention provides these and other related advantages.

SUMMARY OF THE INVENTION

One embodiment of the present invention is a method for coating a portion of a gas turbine engine blade, the method comprising providing a gas turbine blade comprising a superalloy selected form the group consisting of nickel-base superalloys, cobalt-base superalloys, iron-base superalloys, and combinations thereof. The blade further comprises an airfoil section having at least an exterior surface, a platform section having an exterior surface, an under platform section having an exterior surface; and, a dovetail section having an exterior surface, the exterior surface of the dovetail section comprising a shank exterior surface and a serrated exterior surface. The method further comprises applying a layer of silicon-modified aluminum composition to a preselected exterior surface selected from the group consisting of the under platform exterior surface, the dovetail shank exterior surface, and combinations thereof, the silicon-modified aluminum composition comprising a silicon and aluminum particulate component and an additional component selected from the group consisting of a fugitive binder component, a liquid carrier component, at least on chromium-containing salt component, and combinations thereof, the silicon and aluminum particulate component comprising from about 10 weight percent to about 20 weight percent silicon and balance aluminum. The method further comprises heating the gas turbine blade to a preselected temperature in the range of about 600° C. to about 800° C. in a an environment selected from the group consisting of a vacuum and a protective atmosphere. The method further comprises holding the temperature of the gas turbine blade at the preselected temperature for a preselected length of time in the range of about 0.5 hours to about 4 hours to diffuse the aluminum and silicon particulates into the preselected exterior surface to form a silicon-enriched diffusion aluminide coating. The method further comprises cooling the gas turbine blade. The method further comprises cleaning the gas turbine blade.

Another embodiment includes a method for coating a portion of a gas turbine engine blade. The method comprises the steps of providing a gas turbine blade comprising a nickel-base superalloy, the blade further comprising an airfoil section having at least an exterior surface, a platform section having an exterior surface, an under platform section having an exterior surface, a dovetail section having an exterior surface, the exterior surface of the dovetail section comprising a shank exterior surface and a serrated exterior surface. The method further comprises applying a layer of silicon-modified aluminum composition to a preselected exterior surface selected from the group consisting of the under platform exterior surface, the dovetail shank exterior surface, and combinations thereof. The silicon-modified aluminum composition comprises about 35 weight percent aluminum particulates, about 6 weight percent silicon particulates, about 12 weight percent binder salts, and balance water. The method further comprises heating the gas turbine blade to a preselected temperature in the range of about 600° C. to about 800° C. in a an environment selected from the group consisting of a vacuum and a protective atmosphere. The method further comprises holding the temperature of the gas turbine blade at the preselected temperature for a preselected length of time in the range of about 0.5 hours to about 4 hours to diffuse the aluminum and silicon particulates into the preselected exterior surface to form a silicon-enriched diffusion aluminide coating, wherein the silicon-enriched diffusion aluminide coating has a thickness in the range of about 0.5 mils to about 4 mils. The method further comprises cooling the gas turbine blade. The method further comprises cleaning the gas turbine blade.

Another embodiment of the present invention is a gas turbine engine turbine blade comprising a superalloy selected from the group consisting of nickel-base superalloys, iron-base superalloys, cobalt-base superalloys, and combinations thereof, an airfoil section having at least an exterior surface, a platform section having an exterior surface, an under platform section having an exterior surface, and a dovetail section having an exterior surface, the exterior surface of the dovetail section comprising a shank exterior surface and a serrated exterior surface. The blade further comprises a silicon-modified diffusion aluminide layer a surface of a turbine blade section selected from the group consisting of the exterior surface of the under platform section, the exterior surface of the dovetail section, and combinations thereof, the silicon modified diffusion aluminide layer having a concentration of silicon at a surface of the silicon-modified diffusion aluminide layer in the range of about 1 weight percent to about 10 weight percent and a concentration of aluminum at the surface of the silicon modified diffusion aluminide layer in the range of about 5 weight percent to about 25 weight percent.

An advantage of the present invention is that the corrosion resistant coating of the present invention will provide corrosion resistance at elevated temperatures where corrosion damage is more severe.

Another advantage of the present invention is that the corrosion resistant coating of the present invention can be applied at a relatively low temperature with no need for in-process stripping of preselected areas.

Another advantage of the present invention is that that corrosion resistant coating of the present invention can be formed by relatively uncomplicated and inexpensive methods.

Yet another advantage of the present invention is that the corrosion resistant coating of the present invention is compatible with other gas turbine blade coating(s).

Yet another advantage of the present invention is that the corrosion resistant coating of the present invention can used to refurbish existing gas turbine blades for continued engine operation.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
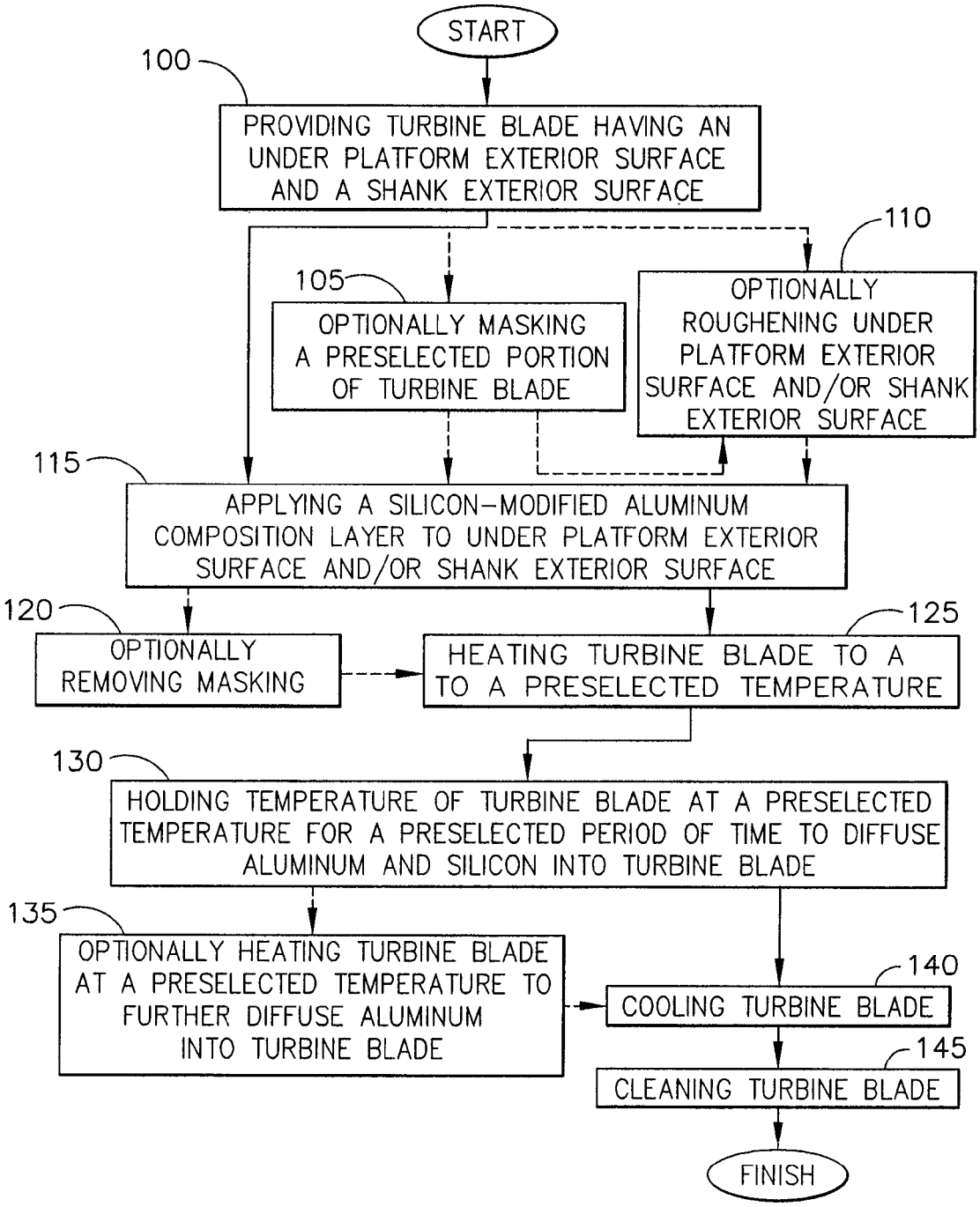
FIG. 1 is a process flow chart illustrating the application of the corrosion resistant coating of the present invention.

As used herein, the term "particulate" refers to a particle, powder, flake, etc., that inherently exists in a relatively small form or can be formed by, for example, grinding, shredding, fragmenting, pulverizing or otherwise subdividing a larger form of the material into a relatively small form.

As used herein, the term "silicon and aluminum particulate component" refers to particulates comprising aluminum particulates and silicon particulates or aluminum and silicon alloy particulates.

As used herein, the term "liquid carrier component" refers to any carrier component that is liquid at ambient temperatures and in which the silicon and aluminum particulate component and fugitive binder component is typically carried in, dispersed in, dissolved in, etc. Liquid carrier components include aqueous systems (e.g., comprising water), organic systems (e.g., comprising alcohols such as ethanol, propanol, isopropanol, etc., other liquid organic materials or solvents such as ethylene glycol, acetone, etc.) or any combination thereof. These liquid carrier components can comprise other optional materials such as surfactants, buffers, etc. Aqueous carrier components can consist essentially of water, i.e., is substantially free of other optional materials, but more typically comprises other optional materials such as compatible organic solvents, surfactants, etc. Suitable surfactants for use in aqueous carrier components can include nonionic surfactants, anionic surfactants, cationic surfactants, amphoteric surfactants, zwitterionic surfactants, or any combination thereof. Illustrative examples of surfactants suitable for use herein include ethoxylated alkyl phenols or aliphatic alcohols, nonionic tertiary glycols, cationic secondary and tertiary amines of the polyoxy cocamine type, quaternary amines, as well as sodium heptadecyl sulfate, sodium tetradecyl sulfate and sodium 2-ethylhexyl sulfate. The inclusion of surfactants can be for the purpose of improving the wettability of the particulate component, reducing the surface tension of the silicon-modified aluminide coating, promoting the formation of improved smoothness and thickness uniformity in the as-applied coating, etc.

As used herein, the term "fugitive binder component" refers to a binder component selected to cure to a solid matrix that holds the aluminum and silicon particulates in contact with the substrate surface during heating to the diffusion temperature. It also is selected to be fugitive during diffusion to yield residues that are only loosely adherent to the surface after diffusion has been completed. Such binders in include materials known to those skilled in the art such as binder salts, organic binders, etc.

As used herein, the term "silicon-modified aluminum composition" refers to any composition comprising a silicon and aluminum particulate component and a fugitive binder component. Optionally, the silicon-modified aluminum composition also contains a liquid carrier component, as such liquid carrier components are known in the art. In a preferred embodiment, the liquid carrier component is water. In a preferred embodiment, the weight percent of silicon in the silicon and aluminum particulate component is in the range of about 10 percent to about 20 percent, balance aluminum. In a most preferred embodiment, the weight percent of silicon in the silicon and aluminum particulate component is about 15 percent, balance aluminum. The liquid carrier component and the fugitive binder composition typically comprise the balance of the silicon modified aluminum slurry. The silicon-modified aluminum composition of this invention can be formulated as flowable solids (e.g., flowable powders), can be formulated as cast tapes comprising a blend, mixture or other combination of the silicon and aluminum particulate and fugitive binder components, with or without a supporting structure such as a film, strip, etc., or can be formulated as liquids. The silicon-modified aluminum compositions of this invention can comprise other optional components such as viscosity modifying or controlling agents, etc. Typically, the silicon-modified aluminum composition is formulated as a liquid composition. The liquid silicon-modified aluminum composition of this invention can be of any desired consistency, flowability, viscosity, etc., including thixotropic or non-thixotropic compositions. If the silicon-modified aluminum composition is prepared as a liquid, the weight percent of the silicon and aluminum particulate component is preferably about 41 weight percent, the fugitive binder component is preferably about 12 weight percent, balance liquid carrier component and optional component(s). The silicon-modified composition may also contain up to 10 weight percent of at least one chromium-containing salt, as such chromium-containing salts are known in the art.

Such silicon-modified aluminum compositions include commercially available silicon-modified aluminum compositions, for example, Sermaloy J (from Sermatech International, Inc. of Pottstown, Pa.). It is believed that the Sermalloy J composition comprises about 35 weight percent aluminum particulates, about 6 weight percent silicon particulates, about 12 percent binder salts (as the fugitive binder) and about 47 weight percent water (as the liquid carrier) based on the description provided in U.S. Pat. No. 6,126,758, which is assigned to Sermatech International, Inc. and Rolls-Royce, plc., and which is hereby incorporated by reference in its entirety.

As used herein the phrase "aluminide layer" refers to aluminide and platinum aluminide coatings as known in the art, including newly applied coatings and coatings that have previously been in service in a gas turbine engine. Typically, these coatings are applied using a diffusion process.

As used herein, the term "comprising" means various particulates, materials, coatings, compositions, components, layers, steps, etc., can be conjointly employed in the present invention. Accordingly, the term "comprising" encompasses the more restrictive terms "consisting essentially of" and "consisting of."

All amounts, parts, ratios and percentages used herein are by weight unless otherwise specified.

Figure 2:
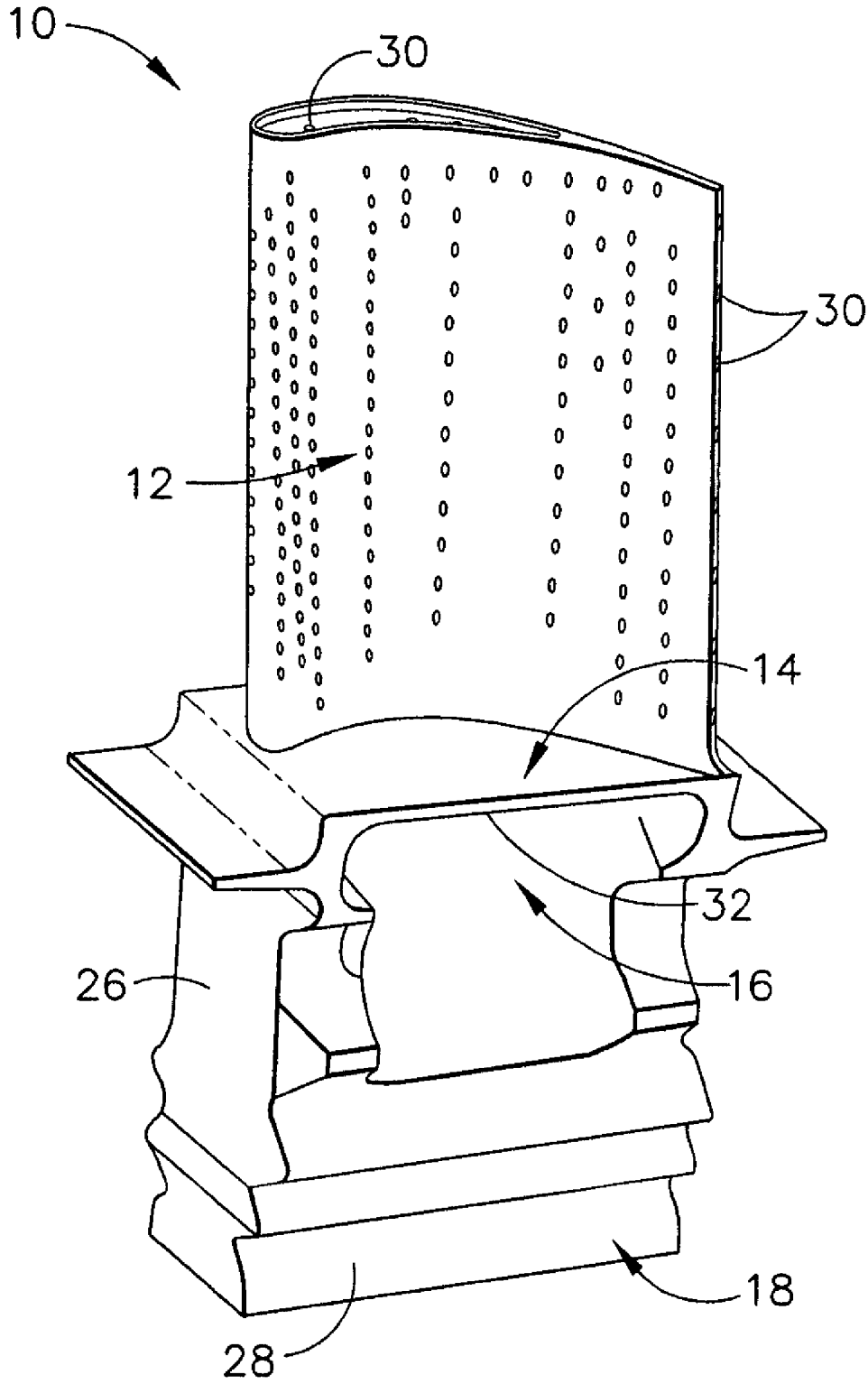
FIG. 2 is perspective view of an embodiment of a turbine blade coated with the corrosion resistant coating of the present invention.
Figure 3:
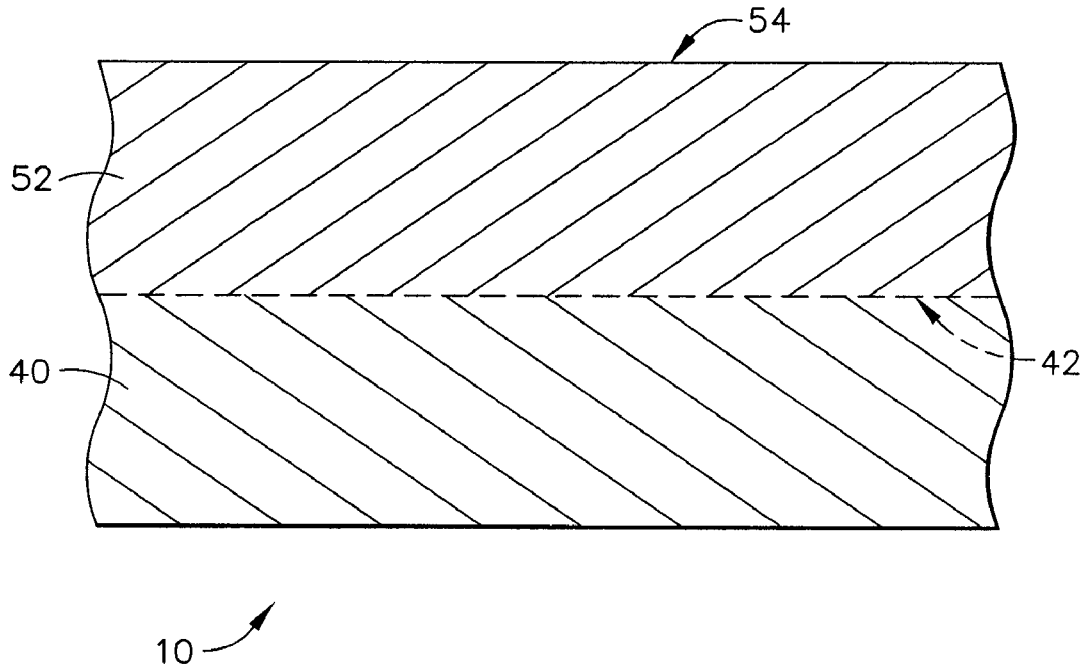
FIG. 3 is a schematic view of a corrosion resistant coating of the present invention deposited on a substrate.

Referring now to FIG. 1 there is shown the method of the present invention for applying a silicon-modified diffusion aluminide coating to the surface of an under platform section and/or the surface of a shank exterior surface of a dovetail section of a gas turbine engine turbine blade. As shown in FIG. 1, the initial step 100 is the provision of a gas turbine engine blade having an under platform exterior surface and a shank exterior surface. As shown in FIG. 2, an exemplary gas turbine engine blade 10 has several sections, including a airfoil section 12 having at least an exterior surface, a platform section 14 having an exterior surface, an under platform section 16 having an exterior surface 32, and a dovetail section 18 having a shank exterior surface 26 and a serrated exterior surface 28. Cooling holes 30 are also shown in FIG. 2. Preferably, the under platform metal substrate 40, shown in FIG. 3 made with the process of FIG. 1 is bare substrate of the under platform exterior surface and/or the shank exterior surface from an as-manufactured superalloy turbine blade 10. Optionally, substrate 40 may be an aluminide layer previously applied to the under platform exterior surface and/or the shank exterior surface. The substrate 40 may also be a partially or completely degraded aluminide layer previously applied to the under platform exterior surface and/or the shank exterior surface. The silicon-modified diffusion aluminide coating of this invention can also be applied during original manufacture of the gas turbine engine blade (i.e., an OEM turbine blade), after the turbine blade has been in operation for a period of time, after other coatings have been removed from the turbine blade (e.g., a repair situation), etc.

The metal substrate 40 of the gas turbine engine blade 10 can comprise any of a variety of metals, or more typically metal alloys, including those based on nickel, cobalt and/or iron alloys. Substrate 40 typically comprises a superalloy based on nickel, cobalt and/or iron. Such superalloys are well-known in the art. In a preferred embodiment, the substrate is a nickel-base superalloy.

Turbine blade substrate 40 more typically comprises a nickel-based alloy, and particularly a nickel-based superalloy, that has more nickel than any other element. The turbine blade 40 may be a new-make turbine blade or a turbine blade selected from the group consisting of a repaired used blade, an upgraded used blade, and a restored used blade. The nickel-based superalloy can be strengthened by the precipitation of gamma prime or a related phase. A nickel-based superalloy for which the corrosion resistant coating of this invention is particularly useful is available by the trade name René N5, having a nominal composition in weight percent of about 7.5 percent cobalt, about 7.0 percent chromium, about 1.5 percent molybdenum, about 5 percent tungsten, about 3 percent rhenium, about 6.5 percent tantalum, about 6.2 percent aluminum, about 0.15 percent hafnium, about 0.05 percent carbon, about 0.004 percent boron, about 0.01 percent yttrium, balance nickel and incidental impurities. Another nickel-based superalloy for which the corrosion resistant coating is particularly useful is available under the trade name René 142, having a nominal composition in weight percent of about 12 percent cobalt, about 6.8 percent chromium, about 1.5 percent molybdenum, about 4.9 percent tungsten, about 2.8 percent rhenium, about 6.35 percent tantalum, about 6.15 percent aluminum, about 1.5 percent hafnium, about 0.2 percent iron, about 0.1 percent manganese, about 0.12 percent carbon, about 0.015 percent boron, balance nickel and incidental impurities.

The next optional step 105 is the masking of a preselected portion of the turbine blade 10, wherein the portion masked is the portions of the blade 10 leaving a non-masked exterior surface selected from the group consisting of the under platform exterior surface 32, dovetail shank exterior surface 26 and combinations thereof, unmasked. The next optional step 110 is roughening the under platform exterior surface 32 and/or the dovetail shank exterior surface 26 to make the such substrate surface(s) 40 more receptive to the application of the coating of the present invention. Such roughening includes chemical and/or mechanic pretreatment. Suitable pretreatment methods include grit blasting, with or without masking of surfaces that are not to be subjected to grit blasting (see U.S. Pat. No. 5,723,078 to Nagaraj et al, issued Mar. 3, 1998, especially col. 4, lines 46-66, which is incorporated by reference in its entirety), micromachining, laser etching (see U.S. Pat. No. 5,723,078 to Nagaraj et al, issued Mar. 3, 1998, especially col. 4, line 67 to col. 5, line 3 and 14-17, which is incorporated by reference in its entirety), treatment with chemical etchants such as those containing hydrochloric acid, hydrofluoric acid, nitric acid, ammonium bifluorides and mixtures thereof, (see, for example, U.S. Pat. No. 5,723,078 to Nagaraj et al, issued Mar. 3, 1998, especially col. 5, lines 3-10; U.S. Pat. No. 4,563,239 to Adinolfi et al, issued Jan. 7, 1986, especially col. 2, line 67 to col. 3, line 7; U.S. Pat. No. 4,353,780 to Fishter et al, issued Oct. 12, 1982, especially col. 1, lines 50-58; and U.S. Pat. No. 4,411,730 to Fishter et al, issued Oct. 25, 1983, especially col. 2, lines 40-51, all of which are hereby incorporated by reference in their entireties), treatment with water under pressure (i.e., water jet treatment), with or without loading with abrasive particles, as well as various combinations of these methods. Typically, the surface 42 of metal substrate 40 is pretreated by grit blasting where surface 42 is subjected to the abrasive action of silicon carbide particles, steel particles, alumina particles or other types of abrasive particles. These particles used in grit blasting are typically alumina particles and typically have a particle size of from about 600 to about 35 mesh (from about 25 to about 500 micrometers), more typically from about 360 to about 35 mesh (from about 35 to about 500 micrometers).

The next step 115 is applying a layer of silicon-modified aluminum composition on the surface 42 of the metal substrate 40. The silicon-modified aluminum composition can be deposited in solid form, e.g., as a flowable solid, as a cast tape (e.g., a cast tape formed as a layer or plurality layers of particulates adhered together as a coherent mass or matrix by the binder, with or without a supporting structure such as a film, strip, etc.), etc, to provide a solid layer of the silicon-modified aluminum comprising the corrosion resistant particulates and binder component. More typically, the silicon-modified aluminum composition is deposited as a liquid, e.g., an aqueous coating composition. Liquid silicon-modified aluminum composition of this invention can be deposited on substrate 40 by any manner of application for depositing liquids including pouring, flowing, dipping, brushing, spraying, rolling, etc., to provide an uncured layer of the composition comprising the particulates and binder component. The next optional step 120 is removing the maskant from the turbine blade 10 as known in the art, if maskant was applied in optional step 105.

The next step 125 is heating the turbine blade 10 in a protective atmosphere (e.g. argon, etc.) or a vacuum to a preselected temperature in the range of about 600° C. to about 800° C. In a preferred embodiment, the preselected temperature is in the range of about 700° C. to about 800° C. The next step 130 is holding the temperature of the turbine blade at the preselected temperature for a preselected period of time to cause the silicon and aluminum particulate component to diffuse into the substrate to form a silicon-modified diffusion aluminide layer 52 adjacent to the substrate 40, the diffusion aluminide layer 52 having a new surface 54. The preselected period of time is preferably in the range of about 0.5 hours to about 4 hours. The fugitive binder component is burned off or vaporized during the steps of heating 125 and holding 130, leaving, at most, a loosely adherent residue on the surface of the newly formed silicon-modified diffusion aluminide layer. If any liquid carrier component is present in the deposited coating composition, the liquid carrier component is evaporated and/or vaporized during the steps of heating 125 and holding 130. The silicon modified diffusion aluminide layer 52 can be formed up to a thickness of about 10 mils (254 microns), and typically has a thickness in the range of from about 0.1 to about 5 mils (from about 3 to about 127 microns), more typically from about 0.5 to about 4 mils (from about 12 to about 102 microns). The next optional step 135 is heating the turbine blade at a second preselected temperature in the range of about 700° C. to about 900° C. for a second preselected period of time in the range of about 1 hour to about 4 hours to further diffuse the aluminum into the substrate 40.

The next step 140 is cooling the turbine blade 10 to ambient temperature. The final step is cleaning the turbine blade as known in the art to remove any residue from the turbine blade component 10.

Another embodiment of the present invention is a turbine blade 10 wherein the shank exterior surface 26 of the dovetail and/or the exterior surface 32 of the under platform section 16 is coated with the silicon-modified diffusion aluminide layer 52 of the present invention. The weight percent of silicon at the surface 54 of the silicon modified diffusion aluminide layer 52 is preferably in the range of 1 weight percent to about 10 weight percent, while the weight percent of aluminum at the surface 54 of the silicon-modified diffusion aluminide layer 52 is in the range of about 5 weight percent to about 25 weight percent.

During an investigation leading to this invention, a test using N5 specimens coated with platinum aluminide and Sermaloy J coatings were evaluated in a corrosion test. Each test cycle was performed at 1400 F for 22 hours in presence of a mixture of sulfates of calcium, potassium, sodium and magnesium. The life of the platinum aluminide coating was 2 cycles, whereas the Sermaloy J coating had a life of 15 cycles.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims

What is claimed is:

1. A gas turbine engine blade comprising:

a superalloy selected from the group consisting of nickel-base superalloys, iron-base superalloys, cobalt-base superalloys, and combinations thereof;

an airfoil section having at least an exterior surface;

a platform section having an exterior surface;

an under platform section having an exterior surface; and a dovetail section having an exterior surface, the exterior surface of the dovetail section comprising a shank exterior surface and a serrated exterior surface; and a silicon-modified diffusion aluminide layer disposed on a turbine blade section selected from the group consisting of the exterior surface of the under platform section, the exterior surface of the dovetail section, and combinations thereof, the silicon modified diffusion aluminide layer having a concentration of silicon in the range of about 1 weight percent to about 10 weight percent and a concentration of aluminum in the range of about 10 weight percent to about 20 weight percent.

2. The gas turbine engine blade of claim 1, wherein the blade is a new make blade.

3. The gas turbine engine blade of claim 1, wherein the blade is selected from the group consisting of a repaired used blade, an upgraded used blade, and a restored used blade.

4. The gas turbine engine blade of claim 1, wherein the blade comprises a nickel-base superalloy.

5. The gas turbine engine blade of claim 1, wherein the superalloy is a nickel-base superalloy.

6. The gas turbine engine blade of claim 1, wherein the nickel-base superalloy comprises less than about 12 weight percent chromium.

7. The gas turbine engine blade of claim 1, wherein the silicon-modified diffusion aluminide layer has a thickness in the range of about 0.1 mils to about 5 mils.

8. The gas turbine engine blade of claim 7, wherein the silicon-modified diffusion aluminide layer has a thickness in the range of about 0.5 mils to about 4 mils.

9. The gas turbine engine blade of claim 1, wherein the silicon-modified aluminum layer is derived from a composition, the composition comprising a binder component, a silicon and aluminum component, and an additional component selected from the group consisting of a liquid carrier component, at least one chromium-containing salt component, and combinations thereof.

10. The gas turbine engine blade of claim 9, wherein the silicon-modified aluminum layer is derived from a composition, the composition further comprising about 35 weight percent aluminum particulates; about 6 weight percent silicon particulates; about 12 weight percent binder salts; and balance water.

11. The gas turbine engine blade of claim 10, wherein the silicon-modified aluminum layer being prepared by being heated to a preselected temperature in the range of about 600° C. to about 800° C. in an environment selected from the group consisting of a vacuum and a protective atmosphere for a period of about 0.5 hours to about 4 hours.

12. The gas turbine engine blade of claim 11, wherein the silicon-modified aluminum layer includes aluminum and silicon particulates diffused into the preselected exterior surface.

13. The gas turbine engine blade of claim 10, wherein the additional component is the at least one chromium-containing salt component, wherein the at least one chromium-containing salt comprises up to about 10 weight percent of the silicon-modified composition.

14. A gas turbine blade comprising a superalloy selected form the group consisting of nickel-base superalloys, cobalt-base superalloys, iron-base superalloys, and combinations thereof, the blade further comprising:

an airfoil section having at least an exterior surface;

a platform section having an exterior surface;

an under platform section having an exterior surface; and a dovetail section having an exterior surface, the exterior surface of the dovetail section comprising a shank exterior surface and a serrated exterior surface;

a layer prepared by applying a silicon-modified aluminum composition onto a preselected exterior surface selected from the group consisting of the under platform exterior surface, the dovetail shank exterior surface, and combinations thereof, the silicon-modified aluminum composition comprising a silicon and aluminum particulate component and an additional component selected from the group consisting of a fugitive binder component, a liquid carrier component, at least one chromium-containing salt component, and combinations thereof, the silicon and aluminum particulate component comprising about 10 weight percent to about 20 weight percent silicon and balance aluminum;

the exterior surface being prepared by heating at a preselected temperature in the range of about 600° C. to about 800° C. in an environment selected from the group consisting of a vacuum and a protective atmosphere; and the exterior surface being prepared by holding the temperature of the gas turbine blade at the preselected temperature for a preselected length of time in the range of about 0.5 hours to about 4 hours to diffuse the aluminum and silicon particulates into the preselected exterior surface to form a silicon-enriched diffusion aluminide coating.

15. The gas turbine engine blade of claim 14, wherein the blade is a new make blade.

16. The gas turbine engine blade of claim 14, wherein the blade is selected from the group consisting of a repaired used blade, an upgraded used blade, and a restored used blade.

17. The gas turbine engine blade of claim 14, wherein the blade comprises a nickel-base superalloy.

18. The gas turbine engine blade of claim 14, wherein the superalloy is a nickel-base superalloy.

19. The gas turbine engine blade of claim 14, wherein the nickel-base superalloy comprises less than about 12 weight percent chromium.

20. The gas turbine engine blade of claim 14, wherein the silicon-modified diffusion aluminide layer has a thickness in the range of about 0.5 mils to about 4 mils.

* * * * *